United States Patent [19]

Sellards

[11] 4,256,199

[45] Mar. 17, 1981

[54] SELF-POWERED, CABLE-MOUNTED TROLLEYS AND BUILDING RESCUE SYSTEM

[76] Inventor: Archibald B. Sellards, 4324 E. Southern, Mesa, Ariz. 85206

[21] Appl. No.: 7,426

[22] Filed: Jan. 29, 1979

[51] Int. Cl.[3] ..... A62B 1/02

[52] U.S. Cl. ..... 182/11; 182/193; 188/65.4; 254/302; 254/333

[58] Field of Search ..... 182/10, 11, 191, 193, 182/5-7, 142, 143, 144; 187/6, 17; 254/135 R; 188/65.4

[56] References Cited

U.S. PATENT DOCUMENTS

| | | | |
|---|---|---|---|
| 276,090 | 4/1883 | Sperry | 182/50 |
| 3,018,934 | 1/1962 | Good | 254/135 R |
| 3,251,435 | 5/1966 | Fisher | 182/142 |
| 3,739,875 | 6/1973 | Padwicki | 182/192 |
| 3,826,335 | 7/1974 | Allen | 182/10 |
| 4,114,726 | 9/1978 | Sentinella | 182/5 |

FOREIGN PATENT DOCUMENTS

| | | | |
|---|---|---|---|
| 864960 | 4/1961 | United Kingdom | 187/6 |

*Primary Examiner*—Reinaldo P. Machado
*Attorney, Agent, or Firm*—Drummond and Nelson

[57] ABSTRACT

A self-powered, cable-mounted trolley for moving the load along a cable includes a housing, pulleys including at least one driven pulley journaled for rotation in the housing for frictionally engaging the cable passing therethrough and a motor and transmission to supply power to the driven pulley. Means are provided for attaching the load to the housing.

The trolley is useful in a building rescue system for moving a load upwardly and downwardly on a tensioned cable attached to an upper portion of the building and extending downwardly to a safe location.

2 Claims, 7 Drawing Figures

SELF-POWERED, CABLE-MOUNTED TROLLEYS AND BUILDING RESCUE SYSTEM

This invention relates to a self-powered trolley for moving a load along a cable.

In another aspect, the invention concerns a building rescue system employing such a self-powered trolley.

Trolleys for moving a load along a cable are used in a wide variety of situations such as in mining, construction activities, etc., and are especially useful in emergency situations such as ship-to-ship personnel or load transfers and for rescuing persons or property from elevated locations, especially in case of fire in a highrise building.

Several prior art patents have provided systems for rescuing persons or property from multi-story buildings, all of which systems include some means for attaching a tensioned cable to an upper part of the building which extends downwardly to a safe location and some means for moving a load at least downwardly along the tensioned cable. For example, the patents to Griffin U.S. Pat. No. 275,197 and Taylor U.S. Pat. No. 1,069,088 disclose grappeling hooks with attached cables which are fired from a ground-mounted cannon. The cables are then used to raise rope escape ladders or cable-mounted carriages to the upper floors of the building. The patents to Holmes U.S. Pat. No. 3,860,092 and Hillier U.S. Pat. No. 734,230 disclose block and tackle systems which are carried to the upper floors of the building. The cables are then used to raise or lower carriages or baskets by means of ground-winches. The patents to Klein U.S. Pat. No. 1,575,344 and Thomas U.S. Pat. No. 1,684,251 disclose specific methods and apparatus for attaching winches which are used to raise and lower rescue cages. The patents to Brunette U.S. Pat. No. 3,927,734 and Wray U.S. Pat. No. 933,685 disclose various mechanisms for lowering an emergency seat along a cable.

However, all of the above-described prior art systems involve apparatus for raising or lowering the trolley along the cable which employs motors mounted at locations remote from the trolley such as atop the building or on the ground, etc. Such remote power sources cause needless complication of the apparatus and involve additional elements such as cables, pulleys, etc. which are subject to possible malfunction. Accordingly, it is a principal object of the present inventon to provide a self-powered trolley for moving a load along a cable.

Another object of the invention is to provide a self-powered trolley which would be especially useful in building rescue systems.

Yet another object of the invention is to provide a self-powered, cable-mounted trolley which would also be useful in other applications such as in mining, mountain rescuing, construction work and the like.

These and other objects and advantages of the invention will be apparent from the following detailed description thereof, taken in conjunction with the drawings, in which.

Briefly, in accordance with the invention, I provide a trolley for moving a load along a cable. The trolley comprises an elongate housing having apertures in opposite sides thereof which are shaped and dimensioned to permit the cable to pass through the apertures and the housing, pulley means are provided, including at least one driven pulley, journaled for rotation within the housing for frictionally engaging the cable passing therethrough. Motor-transmission means are carried by the housing for supplying power to the driven pulley and means are provided for attaching a load to the housing.

In accordance with another aspect of the invention, I provide improvements in prior art building rescue systems. Such systems generally include anchoring means for securing a cable to an upper portion of the building and a cable extending downwardly from the anchoring position to a safe location, means for tensioning the cable and trolley means for moving a load upwardly and downwardly along the cable. The improvement provided by the present invention comprises, in combination with the above-described prior art building rescue systems, pulley means, including at least one driven pulley, mounted on the trolley for frictionally engaging the cable and motor-transmission means carried by the trolley for supplying power to the driven pulley.

Figure 1:
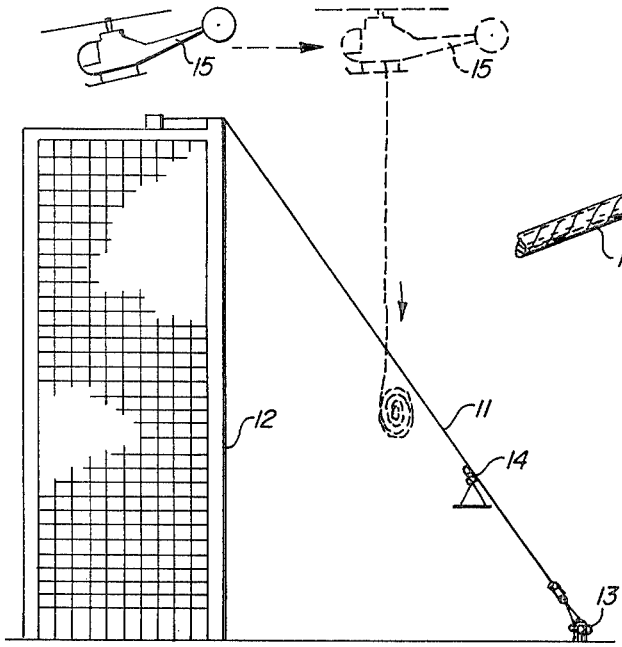
FIG. 1 depicts the various elements of a multi-story building rescue system employing the elements of the present invention.

Turning now to the drawings, which depict the presently preferred embodiments of the invention for purposes of illustration and not by way of limiting the scope thereof, FIG. 1 depicts a building rescue system comprising a cable 11 attached to the roof of a typical office building 12. The cable extends downwardly to a tensioning wench which may be conveniently attached to any solid object, such as a fireplug 13 located at ground level. As indicated, the cable may be attached to the building by any suitable means, such as an anchoring device placed on the roof of the building by a helicopter 15. A trolley 14 embodying the principles of the present invention, which supports a load-carrying platform, is then attached to the cable 11 to transport persons or property from the upper portion of the building 12 to ground level. After placing the cable anchoring device on the roof, the helicopter can move backwardly to the position shown by the dashed lines 15 and drop the cable 11 to ground level and the free end thereof can be affixed to the wench. Alternatively, the upper end of the cable 11 may be attached to the building by firing a projectile such as shown in FIG. 2 from the helicopter through a window of the building.

Figure 2:
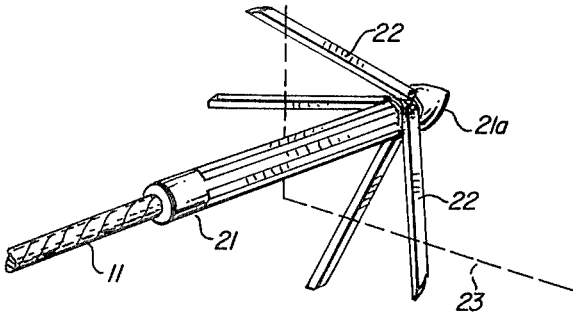
FIG. 2 depicts a suitable cable anchoring device for use in the system of FIG. 1.

As shown in FIG. 2, the projectile can consist of a head portion 21 affixed to the upper end of the cable 11. The head 21 carries collapsible ribs 22 pivotally fixed to the forward end 21A of the body 21. The projectile can be fired through a window, as indicated by the dashed line 23, and the ribs 22 will be displaced to the position shown in FIG. 2 to hold the head 21 secured in the window frame 23. The cable 11 trailing from the head 21 can then be secured to the winch 13 and tensioned appropriately.

Figure 3:
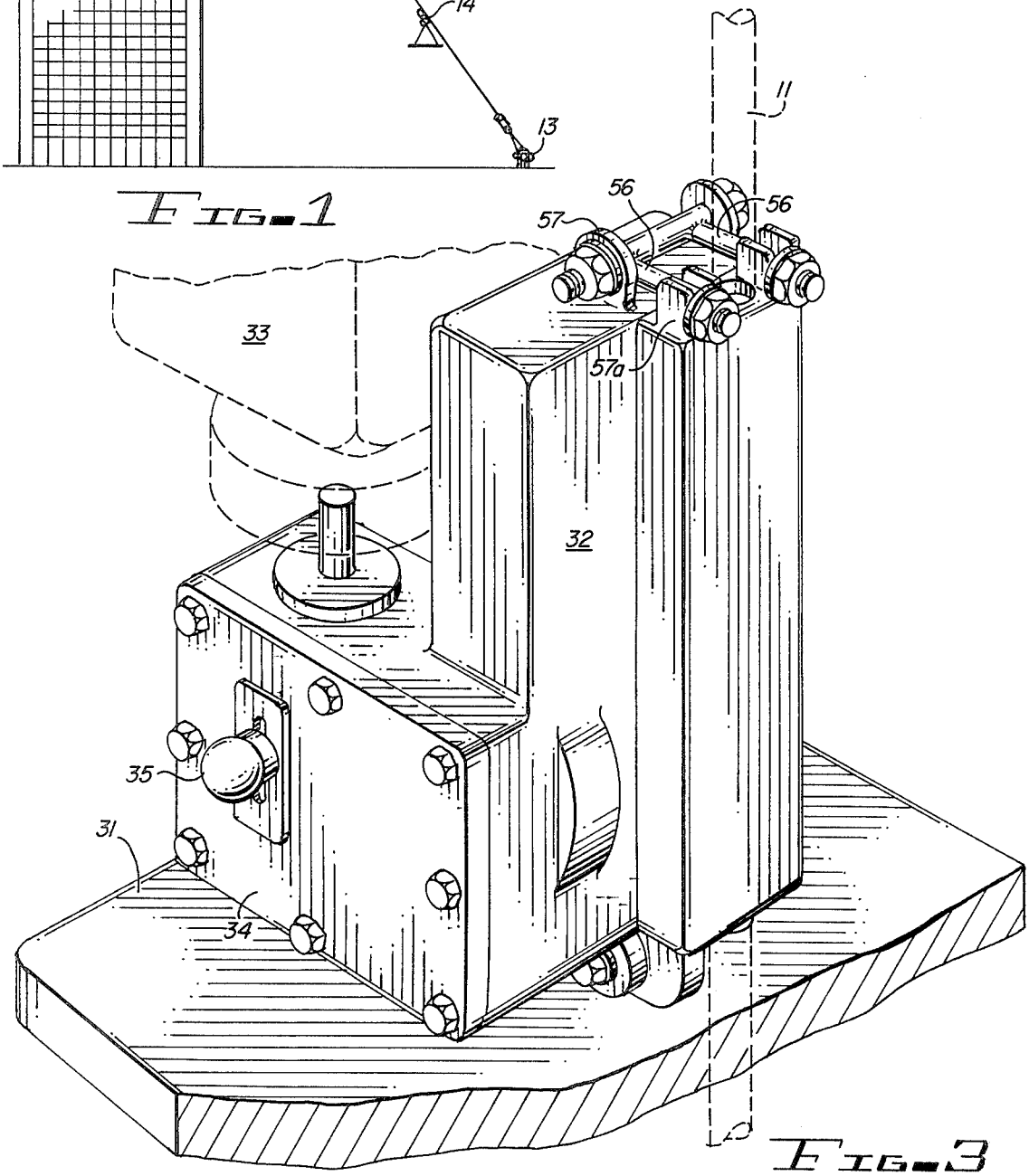
FIGS. 3 and 4 are external views of a self-powered, cable-mounted trolley constructed in accordance with the principals of the present invention.
Figures 4, 7:
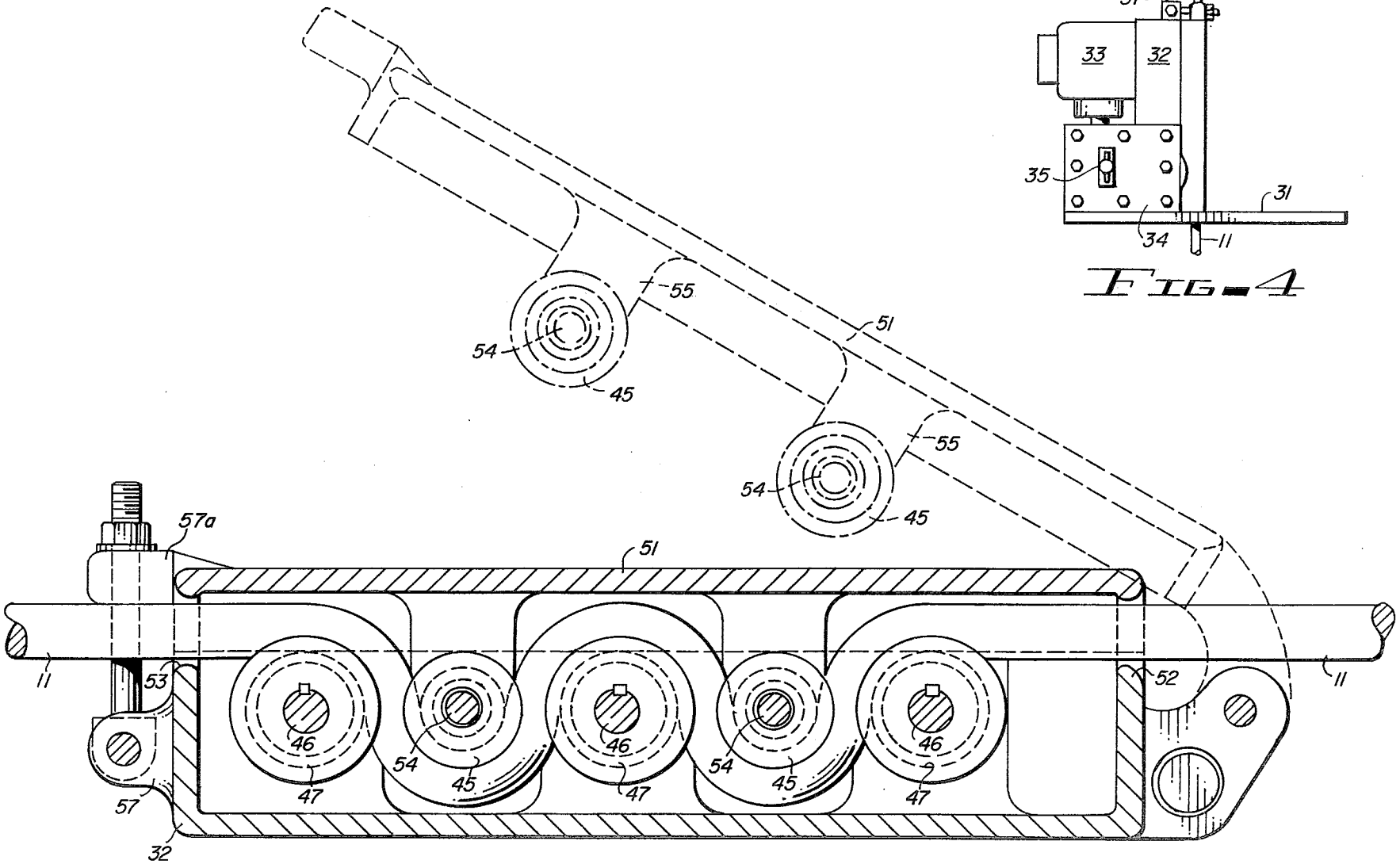
FIG. 7 is a sectional view of the apparatus of FIGS. 3–6 taken along section line 7—7 thereof.

After the cable 11 has been tensioned, a trolley such as that depicted in FIGS. 3 and 4 is affixed to the cable (as will be more fully described below).

As shown in FIGS. 3–4, the trolley consists of a load-carrying platform 31 on which is mounted a housing 32. The cable 11 extends through apertures at opposite sides of the housing 32 and is frictionally engaged by pulleys located within the housing (to be described below). A motor such as a small gasoline powered internal combustion engine 33 is connected through a transmission 34 to the pulley system contained internally of the housing 32 and supplies power to the pulley system to move the entire trolley up and down the cable in response to appropriate positioning of the transmission shift lever 35.

Figure 5:
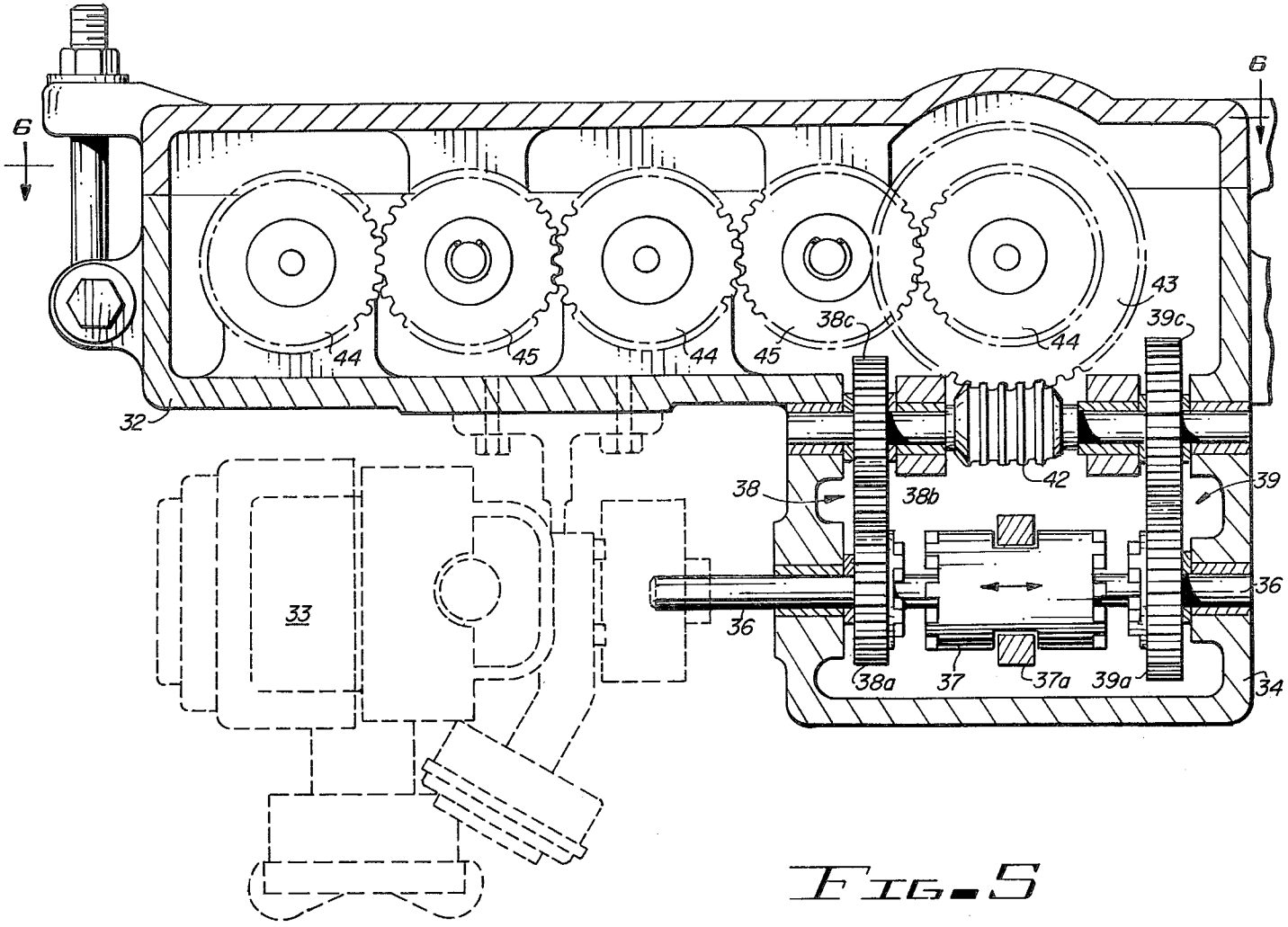
FIG. 5 is a sectional view of the apparatus of FIGS. 3 and 4 taken along section line 5—5 thereof.
Figure 6:
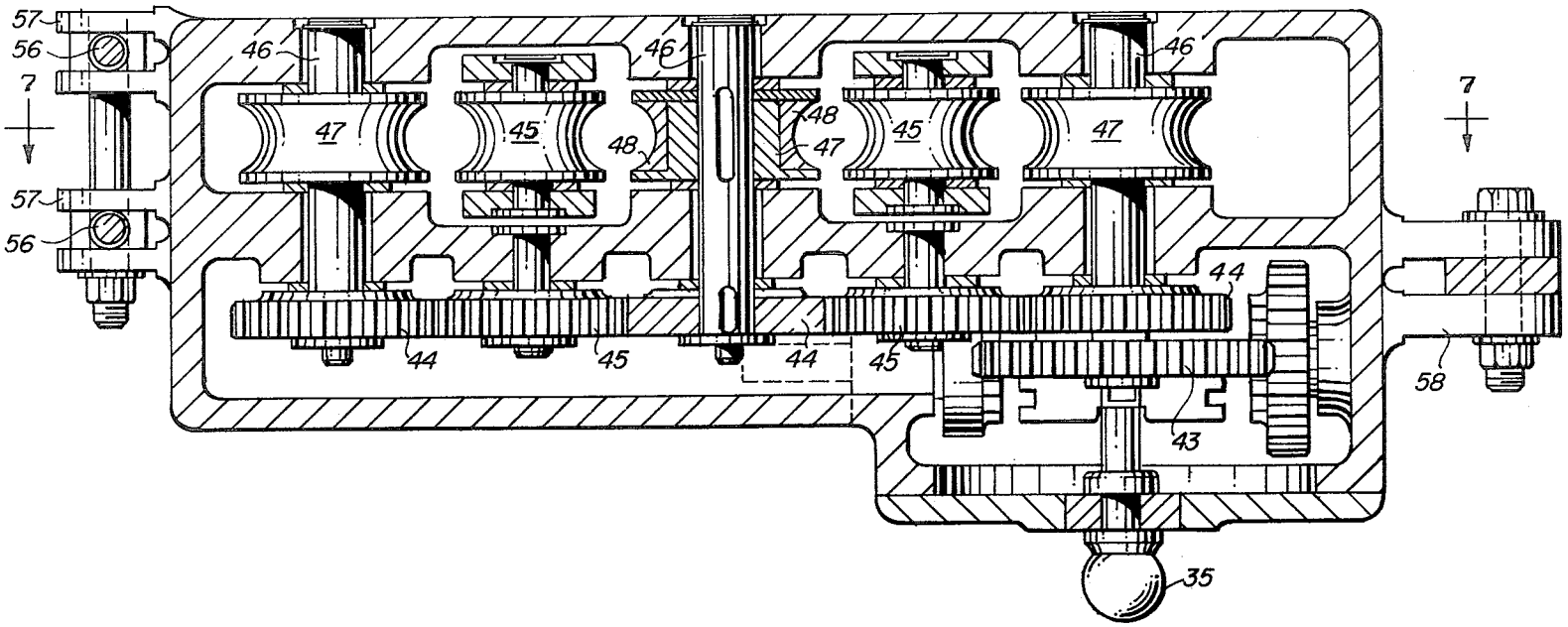
FIG. 6 is a sectional view of the apparatus of FIGS. 3–5 taken along section line 6—6 thereof.

The arrangement and function of the cable engaging pulley system and transmission of the trolley of FIGS. 3–4 are described in FIGS. 5–7. The gasoline engine 33 supplies power through a drive shaft 36 journaled in rotation in the transmission housing 34. A shifting collar 37 (activated by shift yoke 37A attached to shifting handle 35) is keyed to the drive shaft 36 and is slidable therealong from the neutral position (as shown in FIGS. 5 and 6) to engage and supply power to either one of two gear trains, the "down" train, generally indicated by reference character 38, or the "up" train, generally indicated by reference character 39. The "down" train includes driving gear 38A, idler 38B and driven gear 38C. The "up" train consists of driving gear 39A and driven gear 39C. The driven gear 38C and 39C drive a worm 42 which turns worm gear 43 which transmits power through the gear train consisting of driving gears 44 and idler gears 45, all of which are journaled for rotation in the housing 32. The driving gears 44 transmit power through shafts 46 to driven pulleys 47 mounted thereon.

As shown in cross-section on the middle driven pulley 47 of FIG. 6, the driven pulleys and the idler pulleys are provided with cleated, concave, rubber inserts 48 to effectively grip and frictionally engage the cable 11 upon which the trolley is supported.

As shown most clearly in FIG. 7, the trolley of FIGS. 3–5 is affixed to the cable 11 by raising the hinged cover 51 of the housing 32 to the position shown by the dashed lines. The cable 11 is then passed through apertures 52 and 53 in opposite side walls of the housing 32 and is seated in the grooves of the driving pulleys 47 journaled in the housing 32 on shafts 46. The cover 51 carries idler pulleys 45 rotatably mounted on axles 54 journaled in projections 55 carried on the cover 51 of the housing 32 is closed, as shown in FIG. 7, and secured by bolts 56 carried on projecting ears 57 and 57A formed respectively on the housing 32 and the cover 51. The idler pulleys 45 force the portions of the cable 11 extending between the driven pulleys 47 downwardly to the position shown in FIG. 7 and hold the cable 11 in frictional engagement between the idler pulleys 45 and the driven pulleys 47.

The load is fastened to the housing 32 by means of the clevis 58.

Having described my invention in such clear and concise terms as to enable those skilled in the art to understand and practice it, and having identified the presently preferred embodiment thereof, I claim:

1. A trolley for moving a load along a cable comprising:

(a) an elongate housing having apertures in opposite ends thereof shaped and dimensioned to permit said cable to pass through said apertures and said housing;

(b) pulley means including at least one driven pulley and one idler pulley journaled for rotation within said housing for frictionally engaging said cable passing therethrough;

(c) motor-transmission means carried by said housing for supplying power to said driven pulley;

(d) means for attaching said load to said housing;

(e) attachment means integrated with said elongate housing for quickly attaching and detaching said pulley means to and from said cable, said attachment means including an elongate cover pivotally connected at one end to said housing and detachably connected at the other end to said housing, said cover rotatably carrying said idler pulley such that when said cover is closed said cable is threaded between said drive pulley and said idler pulley; and (f) gear shift means mounted on said housing and intergrated with said motor transmission means for altering the direction of rotation of said driven pulley.

2. In a building rescue system including anchor means for securing a cable to an upper portion of said building, a cable extending downwardly from said anchoring position to a safe location, means for tensioning said cable, trolley means for moving a load upwardly and downwardly along said cable, said trolley means including an elongate housing having apertures in opposite ends thereof shaped and dimensioned to permit said cable to pass through said apertures and said housing, the improvement in said system comprising:

(a) pulley means including at least one driven pulley and one idler pulley journaled for rotation within said housing for frictionally engaging said cable passing therethrough;

(b) motor-transmission means carried by said housing for supplying power to said driven pulley;

(c) attachment means integrated with said elongate housing for quickly attaching and detaching said pulley means to and from said cable, said attachment means including an elongate cover pivotally connected at one end to said housing and detachably connected at the other end to said housing, said cover rotatably carrying said idler pulley such that when said cover is closed said cable is threaded between said drive pulley and said idler pulley; and (d) gear shift means mounted on said housing and integrated with said motor transmission means for altering the direction of rotation of said driven pulley.

* * * * *